US006047642A

United States Patent [19]

Hunkeler

[11] Patent Number: 6,047,642

[45] Date of Patent: Apr. 11, 2000

[54] PROCESS AND DEVICE FOR PRODUCING PRINTED MATTER

[75] Inventor: Franz Hunkeler, Zofingen, Switzerland

[73] Assignee: Hunkeler AG Papierverarbeitungsmaschinen, Wikon, Switzerland

[21] Appl. No.: 09/029,978

[22] PCT Filed: Sep. 18, 1996

[86] PCT No.: PCT/CH96/00321

§ 371 Date: Mar. 13, 1998

§ 102(e) Date: Mar. 13, 1998

[87] PCT Pub. No.: WO97/11019

PCT Pub. Date: Mar. 27, 1997

[30] Foreign Application Priority Data

Sep. 22, 1995 [EP] European Pat. Off. ..... 95114985

[51] Int. Cl.[7] ..... B41F 13/56

[52] U.S. Cl. ..... 101/483; 101/226; 101/227; 270/52.07; 270/52.09

[58] Field of Search ..... 101/219, 485, 101/226, 227, 248, 483, 486; 270/52.07, 52.08, 52.09; 53/569

[56] References Cited

U.S. PATENT DOCUMENTS

| | | | |
|---|---|---|---|
| 3,937,452 | 2/1976 | Gäth . | |
| 4,896,605 | 1/1990 | Schröder | 101/486 |
| 5,390,599 | 2/1995 | Matsumoto et al. | 101/483 |
| 5,452,632 | 9/1995 | Dürr et al. | 101/227 |
| 5,458,062 | 10/1995 | Goldberg et al. | 101/227 |
| 5,640,835 | 6/1997 | Muscoplat | 53/569 |
| 5,711,225 | 1/1998 | Rasmussen | 101/483 |
| 5,720,223 | 2/1998 | Mesch | 101/227 |

FOREIGN PATENT DOCUMENTS 0 562 443 A1 3/1993 European Pat. Off. .

*Primary Examiner*—Eugene Eickholt
*Attorney, Agent, or Firm*—Oliff & Berridge, PLC

[57] ABSTRACT

An apparatus produces printed matter, such as forms and publicity material, from a first, continuously fed flexible material web of given width. The first flexible material web is conveyed at a first constant supply speed. A second flexible material web is conveyed at a second constant supply speed lower than the first supply speed. In a cutting station, the second flexible material web is cut into material strips. The supply speed of a leading end region of the second flexible material web is briefly increased periodically by an arrangement provided upstream of the cutting station.

13 Claims, 3 Drawing Sheets

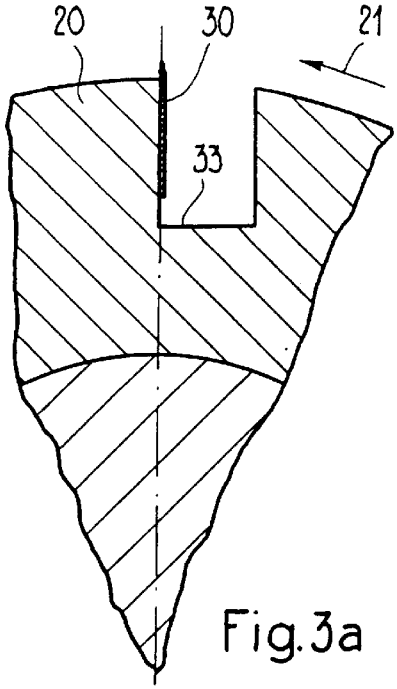
Fig.3a
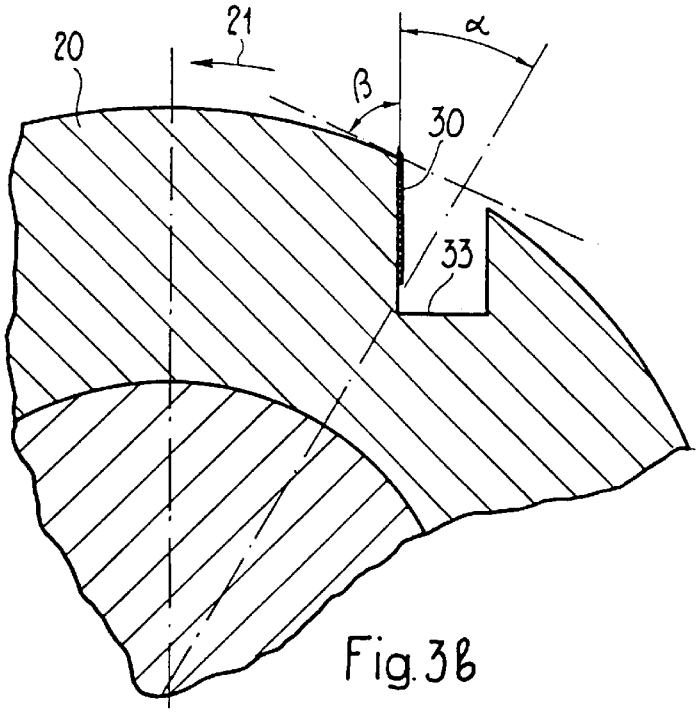
Fig.3b
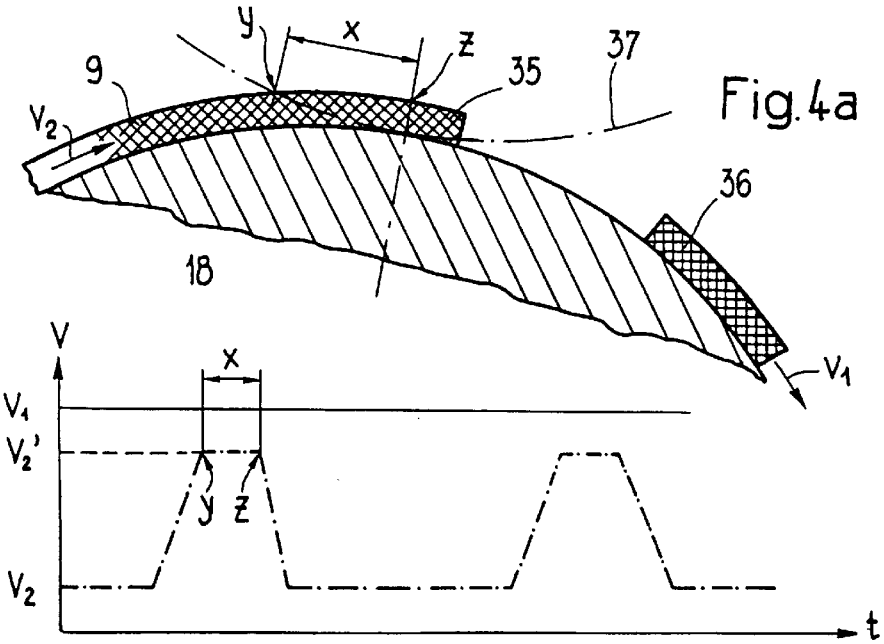
Fig.4a
Fig.4b

PROCESS AND DEVICE FOR PRODUCING PRINTED MATTER

BACKGROUND OF THE INVENTION

1. Field of the Invention

The invention relates to a process and an apparatus for producing printed matter, such as forms and publicity material.

2. Description of Related Art

Processes and apparatuses which are intended for producing printed matter and in the case of which material strips of a continuously fed flexible material web are cut at in-register intervals and applied to a further continuously supplied material web are known. As the operating speed increases, however, the cut-off length of the material strips may be different and, in many cases, it is no longer possible to produce neat cut edges. This results in more rejects being produced, which is increases the costs of the printed matter.

SUMMARY OF THE INVENTION

An object of the present invention is thus to specify a process and an apparatus which are intended for producing printed matter and, in the case of varying thicknesses of the second material web and varying cut-off lengths of material strips produced therefrom, always produce a neat cut edge.

This object is achieved by a process having the features of continuously feeding a first flexible material web at a substantially constant first predetermined speed, feeding a second flexible material web to a cutting station at a substantially constant second predetermined speed lower than the first predetermined speed, cross-cutting the second flexible material web into strips at the cutting station with a cutter that moves at a speed approximately equal to the first predetermined speed, increasing a supply speed of a leading end of the second flexible material web to a speed higher than the second predetermined speed in a region of the cutting station before cross-cutting, lowering the supply speed of the leading end of the second flexible material web after cross-cutting and applying the strips of second flexible material to the first flexible material web at registered intervals at a conveying speed approximately equal to the first predetermined speed.

This object is also achieved by an apparatus having the features of a first conveyor that conveys a first flexible material web at a substantially constant first supply speed, a second conveyor that conveys a second flexible material web at a substantially constant second supply speed lower than the first supply speed, a cutting station that cuts the second flexible material web into strips and a speed adjuster located upstream of the cutting station that periodically increases a supply speed of a leading end of the second flexible material web.

The invention is based on the findings that the circulating cutter acts on the second flexible material web, fed at a slower supply speed, before the actual cutting operation takes place. If, then, shortly before the cutting operation, the leading end region of the second material web is supplied at approximately the same speed as the speed of circulation of the cutter, then the tearing-off action to which the second material web is subjected by the cutter is reduced considerably, this resulting in a neat cut edge even in the case of very wide material webs or in the case of the production of material strips with a short cut-off length.

The great advantage of the invention is that material strips are always produced with a high accuracy of cut and, at the same time, there are no longer any significant delays in the supply of the material strips to the first, continuously fed flexible material web, this resulting in in-register application of the material strips in all circumstances.

If the second material web is fed by a curved suction surface, e.g. the lateral surface of the suction roller, the duration over which the cutter acts on the second material web before the cutting operation is reduced further, this achieving an additional improvement in the actual cutting operation.

BRIEF DESCRIPTION OF THE DRAWINGS

Further advantages can be gathered from the following description. In the latter, the invention is explained in more detail with reference to exemplary embodiments illustrated in the schematic drawings, in which:

FIGS. 3*a* and 3*b* show an enlarged illustration of the cutting roller with two different possible arrangements of the cutter, FIGS. 4*a* and 4*b* respectively show a partial cross section through the suction roller and a speed diagram for explaining how the actual cutting operation progresses over time.

DETAILED DESCRIPTION OF THE PREFERRED EMBODIMENTS

In the figures, the same designations are used for the same elements in each case and, unless expressly mentioned otherwise, the first explanation of each element applies for all the figures.

Figure 1:
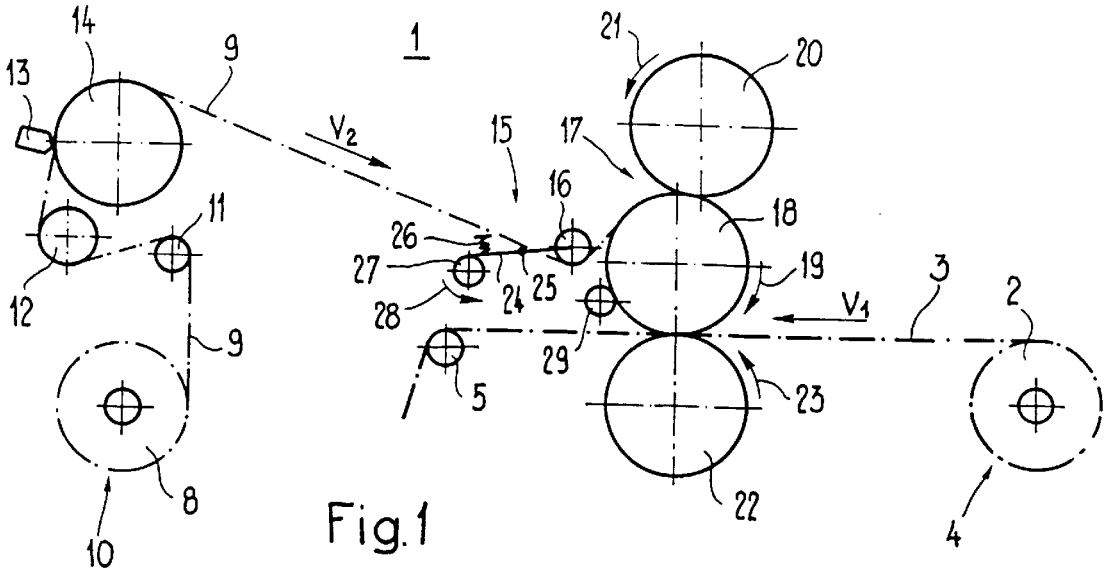
FIG. 1 shows a machine for producing printed matter.

FIG. 1 shows a machine 1 for producing printed matter, in the case of which a first flexible material web 3 is unwound from a roll 2 (or a stack) at an unwinding station, designated in general terms by 4, and is conveyed further to a transporting roller 5 at a constant supply speed $V_1$ via transporting means (not illustrated specifically here). A second flexible material web 9 is unwound from a roll 8, via deflecting rollers 11 and 12, at an unwinding station, designated in general terms by 10, and is guided to an adhesive-applying unit 13 at a constant supply speed $V_2$. The second material web 9 is then guided over a further deflecting roller 14 and via an acceleration unit 15, which has an adhesive-repelling deflecting roller 16, to a cutting station 17, which has a suction roller 18 with a clockwise direction of rotation (arrow 19) and a cutting roller 20 which is located above the suction roller and has an anticlockwise direction of rotation (arrow 21). Arranged beneath the suction roller 18, and opposite it if the first material web 3 is taken as a reference point, is a pressure-exerting roller 22 with an anticlockwise direction of rotation (arrow 23). The deflecting roller 16 is fastened in a freely rotatable manner on a lever 24, which is mounted rotatably about an axis of rotation 25 and has its free end region pressed against a control roller 27 by a compression spring 26. The control roller 27 has corresponding control cams and rotates in the anticlockwise direction (arrow 28), with the result that the deflecting roller 16 is periodically raised from the second material web 9 and brought to bear against it again. In the case of another embodiment, which is not shown, the lever 24 is guided positively in a control groove in a control roller 27. In this case, compression spring 26 is dispensed with. By virtue of this control groove, the lever 24 is moved such that, as has been described, the deflecting roller 16 is periodically raised from the second material web 9 and brought to bear against it again. As seen in direction of rotation 19 of the suction roller 18, the cutting station 17 has provided upstream of it a cleaning roller 29, which cleans lint and the like from the surface of the suction roller 18 beforehand. The roller 29 may also be designed as a lubricant-applying roller, which applies a lubricant, e.g. silicone or powdered talc, to the surface of the suction roller 18 in order to keep the sliding capacity of the surface of the suction roller approximately constant.

Figure 2:
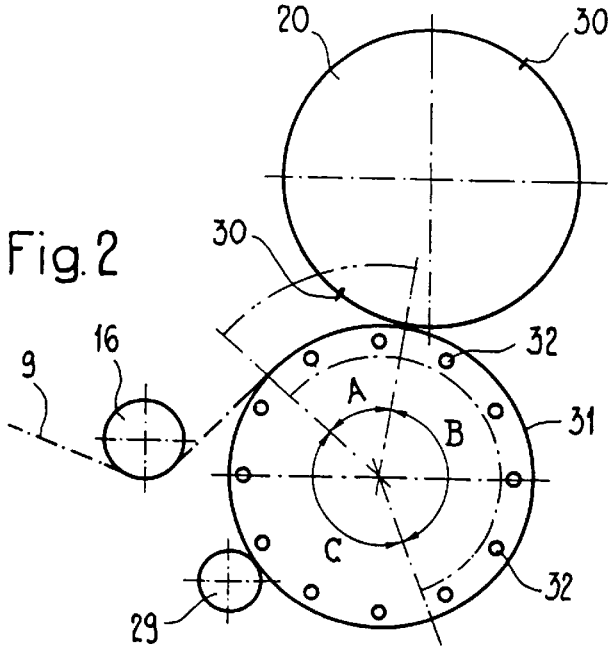
FIG. 2 shows an enlarged illustration of the production machine of FIG. 1 in the region of the cutting station with a first embodiment of the acceleration unit.

FIG. 2 illustrates the cutting roller 20 with two diametrically opposite cutters 30 and the suction roller 18 with three sector-like regions A, B and C. The suction roller 18 is provided with a lateral surface 31 which is designed as a perforated metal plate or suction surface and whose holes, which are aligned in rows in an axis-parallel manner, are connected to suction ducts 32 which are aligned in the axial direction of the suction roller 18. These suction ducts 32 are closed at one end and open at the opposite end. The suction ducts 32 are connected to a negative-pressure source (not illustrated here). Control plates (not illustrated) connect the suction ducts 32 to the negative-pressure source such that, in the sector-like region A, the suction roller 18 serves for transporting the second material web 9 and, in the region B, said suction roller serves for transporting the cut-off material strips further and, in the region C, the suction roller does not have any suction action and may possibly have blowing air admitted to it for cleaning purposes.

The surface of the suction roller 18 is cleaned thoroughly and/or provided with a lubricant by the cleaning or lubricant-applying roller 29, which acts in he sector-like region C, with the result that it is possible to keep the friction ratios between the second flexible material web and the roller surface largely constant. With continuous cleaning and/or a uniform application of lubricant, the operating conditions always remain the same, with the result that in-register feed of the material strips to the first material web 3 can be ensured satisfactorily. In-register feed involves the material strips being applied to the first material web 3 at the correct interval with respect to one another and at the correct location.

FIGS. 3*a* and 3*b* illustrate the cutting roller 20 in two partial cross sections. In FIG. 3*a*, the cutter 30 is aligned in a precisely radial manner and fastened on a wall of a groove 33. In FIG. 3*b*, the cutter 30 and the groove 33 are arranged at an acute angle $\alpha$ with respect to the radius. The cutter 30 thus likewise forms an acute angle $\beta$ of approximately $90°-\alpha$ with respect to the tangent to the cutting roller 20. As a result, the second material web 9 may thus be cut into material strips as if by shearing, i.e. the cutters 30 pierce the second material web 9 at an oblique angle $\beta$ and thus carry said second material web along just before the crosscutting operation.

The functioning of the production machine 1 will now be explained, with reference to FIGS. 1, 4*a* and 4*b*, as follows:

The first material web 3 is supplied between the suction roller 18 and the pressure-exerting roller 22 at a first constant supply speed $V_1$. The second material web 9 is fed to the cutting station 17 at a considerably lower, second constant supply speed $V_2$. Previously, adhesive is applied to the second flexible material web 9 at in-register intervals in the adhesive-applying unit 13. The leading end region 35 of the second material web 9 is deposited on the lateral surface 31 of the suction roller 18, via the deflecting roller 16, at the second supply speed $V_2$. Thereafter, the leading end region 35 is conveyed further, with slippage, at a speed V, which corresponds approximately to the second constant supply speed $V_2$, on the suction roller 18, which rotates at approximately the first supply speed $V_1$. Subsequently, the second material web 9 is crosscut, by the cutters 30 of the cutting roller 20, into material strips 36 with a predetermined cut length, the suction roller 18 serving as anvil for the cutters 30 and the intention being for the application of adhesive to be located within the contours of a material strip 36. For this purpose, the leading end region 35 of the second material web 9 is supplied at a speed $V_2'$ over a period X from the moment of contact of the cutter 30 along the movement path 37 with the second material web 9 (point in time Y) up to the actual cutting operation (point in time Z), said speed $V_2'$ being considerably higher than the second constant supply speed $V_2$. This speed $V_2'$ of the leading end region 35 is to correspond as closely as possible to the first supply speed $V_1$, during the period X (see the speed diagram in FIG. 4*b*). In the case of the first embodiment of FIGS. 1 and 2, this increase in speed takes place by virtue of the deflecting roller 16 being raised by means of the control roller 27, which has corresponding guides for the lever 24 and is rotated in proportion with the speed of rotation of the cutters 30. The maximum increase in speed which can be achieved depends on the slippage on the lateral surface 31 of the suction roller 18 which occurs when the second material web 9 is carried along, and also depends on the expansion in the second material web 9. After the crosscutting operation, the cut-off material strip 36 is conveyed further by the suction roller 18 approximately at the first supply speed $V_1$.

Figure 5:
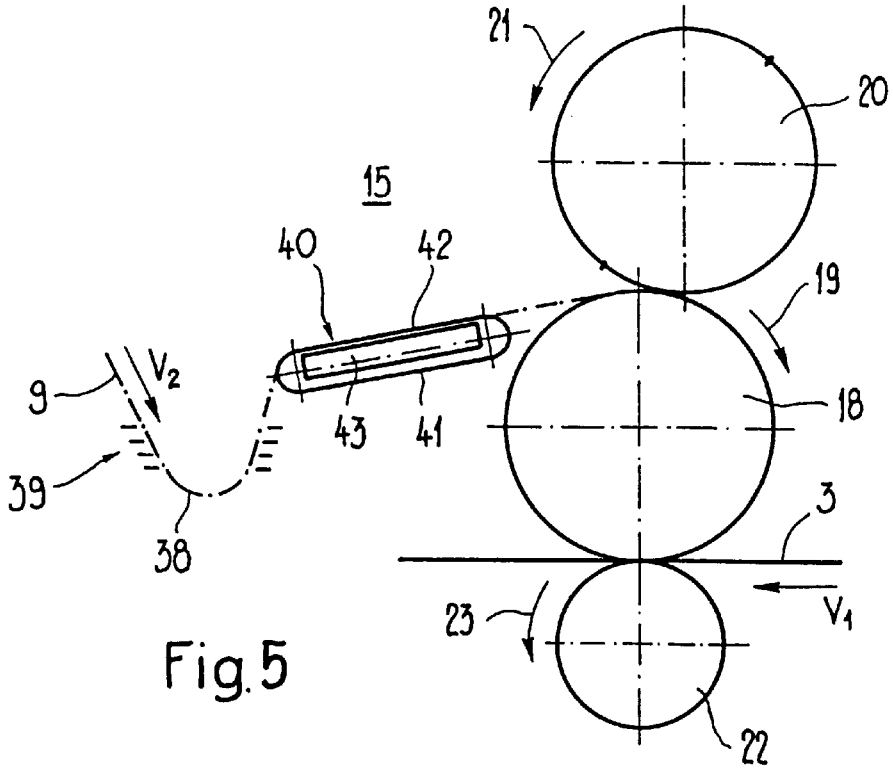
FIG. 5 shows a second embodiment of the acceleration unit.

FIG. 5 illustrates a second embodiment of the acceleration unit 15, in the case of which the second flexible material web 9 is guided in a supply loop 38 and the size of this supply loop 38 is monitored by means of a loop control 39 which is known per se, e.g. a light-barrier control. Provided between the supply loop 38 and the suction roller 18 is a transporting-belt arrangement 40 which has a perforated transporting belt 41, whose conveying strand 42 is guided via a suction chamber 43 connected to a negative-pressure source. The circulating speed of the transporting belt 41 normally corresponds approximately to the supply speed $V_2$ and, in accordance with the speed diagram of FIG. 4*b*, the transporting belt 41 periodically increases the speed V of the leading end region 35 to a speed $V_{2'}$, which corresponds approximately to the first supply speed $V_1$, and slows said end region down again, as in the case of the first embodiment.

Figure 6:
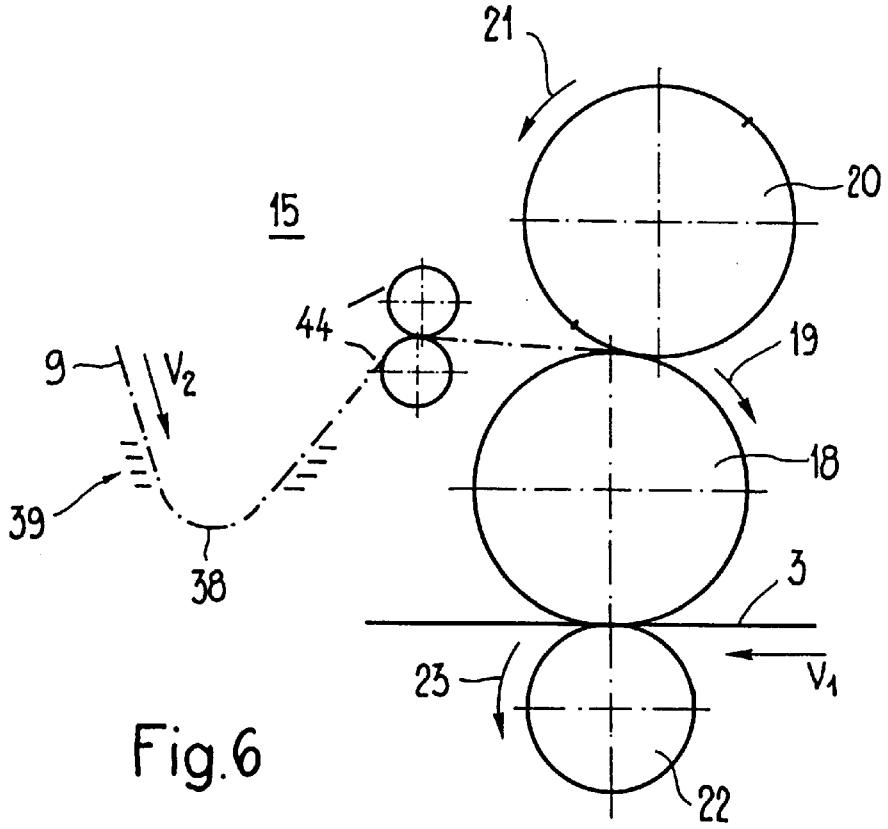
FIG. 6 shows a third embodiment of the acceleration unit.

In FIG. 6, a third embodiment of the acceleration unit 15 is illustrated similarly as in FIG. 5. Provided in this case, instead of a transporting-belt arrangement 40, is a conveying-roller pair 44, which effects the periodic increase in the speed V of the leading end region 35 in accordance with the speed diagram of FIG. 4*b*.

In the case of the embodiments according to FIGS. 5 and 6, the increase in the speed V of the leading end region 35 accordingly takes place by a brief increase and subsequent reduction in the speed of the transporting belt 41 or of the conveying-roller pair 44, respectively. Especially in the case of particularly wide material webs 9, this achieves a clean cut edge over the entire width. Even in the case of material strips 36 with a particularly short cut length or in the case of a thicker second material web 9, the abovementioned process provides for clean and correctly positioned cut edges and there are no delays in the supply of the material strips. This ensures in-register application of the material strips 36, with the application of adhesive, to the first material web 3.

Instead of an application of adhesive, the second material web 9 may already have been provided with an adhesive which is known as a transfer adhesive and is reactivated by the action of heat. It is also possible for the adhesive to have been provided on, or applied to, the first material web 3 already, with the result that the material strips 36 can be applied thereto in in-register fashion. Paper, plastic film or the like are provided as the first and second material webs 3 and 9. Furthermore, it is also possible for the first material web 3 to be advanced in steps rather than continuously.

I claim:

1. An apparatus for producing printed matter from a first flexible material web that is continuously fed, the apparatus comprising:

a first conveying means that conveys the first flexible material web at a first supply speed, the first supply speed being substantially constant;

a second conveying means that conveys a second flexible material web at a second supply speed, the second supply speed being substantially constant and lower than the first supply speed;

a cutting station that cuts the second flexible material web into strips of second flexible material, the strips of second flexible material being supplied to the first flexible material web; and a speed adjusting means located upstream, in relation to the second flexible material web, of the cutting station and that periodically increases a leading and supply speed of a leading end of the second flexible material web.

2. The apparatus of claim 1, wherein the cutting station has a suction roller with a lateral surface and a circulating cutter which interacts with the suction roller.

3. The apparatus of claim 2, wherein the circulating cutter is arranged on a cutting roller at an acute angle with respect to a tangent of the cutting roller.

4. The apparatus of claim 1, further comprising:

an adhesive-applying unit provided upstream, in relation to the second flexible material web, of the cutting station and that applies an adhesive to the second flexible material web at in-register intervals.

5. The apparatus of claim 1, wherein the speed adjusting means has a deflecting roller which is deflected in a controlled manner and deflects the second flexible material web.

6. The apparatus of claim 1, wherein the speed adjusting means has a controllable conveying-roller pair which forms a supply loop in the second flexible material web upstream of the speed adjusting means.

7. The apparatus of claim 1, wherein the speed adjusting means is a controllable perforated transporting-belt arrangement which forms a supply loop in the second flexible material web upstream of the speed adjusting means.

8. The apparatus of claim 2, further comprising a first roller which interacts with the lateral surface of the suction roller, the first roller being one of a cleaning roller and a lubricant-aplying roller.

9. A method of producing printed matter, the method comprising the steps of:

continuously feeding a first flexible material web at a first predetermined speed, the first predetermined speed being substantially constant;

feeding a second flexible material web to a cutting station at a second predetermined speed, the second predetermined speed being substantially constant and lower than the first predetermined speed;

cross-cutting the second flexible material web into strips of second flexible material at the cutting station with a cutter, the cutter moving at a speed approximately equal to the first predetermined speed;

increasing a supply speed of a leading end of the second flexible material web to a speed higher than the second predetermined speed in a region of the cutting station before the cross-cutting;

lowering the supply speed of the leading end of the second flexible material web after the cross-cutting; and applying the strips of second flexible material to the first flexible material web at registered intervals at a conveying speed approximately equal to the first predetermined speed.

10. The method of claim 9, further comprising the steps of:

deflecting the second flexible material web to form a supply loop in the second flexible material web in the region of the cutting station; and increasing the supply speed of the leading end of the second flexible material web in the region of the cutting station before the cross-cutting by reducing a size of the supply loop.

11. The method of claim 10, further comprising the steps of:

positioning the leading end of the second flexible material web on a suction surface which rotates at approximately the first predetermined speed;

conveying the leading end of the second flexible material web on the suction surface so that slippage occurs between the leading end of the second flexible material web and the suction surface, and the leading end of the second flexible material web is conveyed at approximately the second predetermined speed;

performing the cross-cutting essentially transversely with respect to the second flexible material web while the second flexible material web is positioned on the suction surface; and applying the strips of second flexible material to the first flexible material web while the strips of second flexible material are positioned on the suction surface.

12. The method of claim 11, further comprising the steps of:

deflecting the second flexible material web with a deflecting roller to a deflected position at which the second flexible material web contacts a curved area of the suction surface;

moving the deflecting roller out of the deflected position and away from the second flexible material web shortly before the cross-cutting; and moving the second flexible material web into the deflected position with the deflecting roller immediately after the cross-cutting.

13. The method of claim 10, futher comprising the step of increasing the supply speed of the leading end of the second flexible material web by reducing the size of the supply loop by a drive.

* * * * *